US007076193B2

(12) United States Patent
Wing et al.

(10) Patent No.: US 7,076,193 B2
(45) Date of Patent: Jul. 11, 2006

(54) WIRE MODULE FOR DEVELOPER UNIT

(75) Inventors: Joseph M. Wing, Ontario, NY (US); Douglas G. Berner, deceased, late of Penfield, NY (US); by Scott Douglas Berner, legal representative, Tonowanda, NY (US); Ron E. Dufort, Henrietta, NY (US); Robert E. Hildebrand, Webster, NY (US); Michael J. Martin, Hamlin, NY (US); Barbara J. Schaeffer, Penfield, NY (US); James J. Spence, Honeoye Falls, NY (US)

(73) Assignee: Xerox Corporation, Stamford, CT (US)

( * ) Notice: Subject to any disclaimer, the term of this patent is extended or adjusted under 35 U.S.C. 154(b) by 152 days.

(21) Appl. No.: 10/853,811

(22) Filed: May 26, 2004

(65) Prior Publication Data

US 2005/0265754 A1 Dec. 1, 2005

(51) Int. Cl.
*G03G 15/08* (2006.01)

(52) U.S. Cl. ..... 399/266; 399/291

(58) Field of Classification Search ..... 399/266, 399/265, 290, 291
See application file for complete search history.

(56) References Cited

U.S. PATENT DOCUMENTS 4,868,600 A 9/1989 Hays et al. ..... 399/266
4,984,019 A 1/1991 Folkins ..... 399/99
5,270,483 A * 12/1993 Inoue et al. ..... 399/266
5,321,474 A * 6/1994 Bares ..... 399/266
5,338,893 A * 8/1994 Edmunds et al. ..... 399/266
5,422,709 A 6/1995 Minagawa et al. ..... 399/291
5,600,416 A * 2/1997 Hart ..... 399/291
5,640,657 A * 6/1997 Hart et al. ..... 399/291
5,666,619 A * 9/1997 Hart et al. ..... 399/266
6,181,896 B1 * 1/2001 Zirilli et al. ..... 399/266 X

FOREIGN PATENT DOCUMENTS

JP 04-299193 A * 10/1992
JP 06-067547 A * 3/1994
JP 08-142388 A * 6/1996

* cited by examiner

*Primary Examiner*—Sophia S. Chen
(74) *Attorney, Agent, or Firm*—Lloyd F. Bean, II

(57) ABSTRACT

An apparatus for developing in a development zone a latent image recorded on a surface, including a housing defining a chamber storing at least a supply of toner therein; a donor member disposed of at least partially in the chamber of the housing and spaced from the surface, the donor member being adapted to rotate about a longitudinal axis to transport toner to the development zone in a region opposed from the surface; and a wire assembly module mounted the development zone and extending in a direction transverse to the longitudinal axis, the wire assembly module including a wire and a drive system for translating portions of the wire in the development zone, and power supply for electrically biasing the wire to detach toner from the donor member so as to form a toner powder cloud in the development zone with detached toner from the toner cloud developing the latent image.

16 Claims, 5 Drawing Sheets

WIRE MODULE FOR DEVELOPER UNIT

BACKGROUND

This invention relates generally to an electrophotographic printing machine, and more particularly concerns wire module having translating wires driven by rotating spools for use in a scavengeless developer unit.

SUMMARY

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive member. After the electrostatic latent image is recorded on the photoconductive member, the latent image is developed by bringing a developer material into contact therewith. Two component and single component developer materials are commonly used. A typical two component developer material has magnetic carrier granules with toner particles adhering triboelectrically thereto. A single component developer material typically comprises toner particles. Toner particles are attracted to the latent image forming a toner powder image on the photoconductive member. The toner powder image is subsequently transferred to a copy sheet. Finally, the toner powder image is heated to permanently fuse it to the copy sheet in image configuration.

One type of single component development system is a scavengeless development system that uses a donor roll for transporting charged toner to a development zone. A plurality of electrode wires are closely spaced to the donor roll in the development zone. An AC voltage is applied to the wires forming a toner cloud in the development zone. The electrostatic fields generated by the latent image attract toner from the toner cloud to develop the latent image. A hybrid scavengeless development system employs a magnetic brush developer roller for transporting carrier having toner adhering triboelectrically thereto. The donor roll and magnetic brush roll are electrically biased relative to one another. Toner is attracted to the donor roll from the magnetic brush roll. The donor roll transports the charged toner to a development zone. The electrically biased electrode wires detach the toner from the donor roll forming a toner powder cloud in the development zone, and the latent image attracts the toner particles thereto. In this way, the latent image recorded on the photoconductive member is developed with the toner particles. It has been found that streaks are formed in the developed latent image when debris is trapped in, or when toner and/or toner constituents builds up on the electrode wires. Heretofore, the electrode wires have been positioned substantially perpendicular to the process direction, i.e. substantially parallel to the longitudinal axis of the donor roll. Various types of development systems have hereinbefore been used incorporating electrode wires as illustrated by the following disclosures, which may be relevant to certain aspects of the present invention:

U.S. Pat. No. 4,868,600 describes an apparatus wherein a magnetic roll transports two component developers to a transfer region where toner from the magnetic roll is transferred to a donor roll. The donor roll transports the toner to a region opposed from a surface on which a latent image is recorded. A pair of electrode wires are positioned in the space between the surface and the donor roll and are electrically biased to detach toner from the donor roll to form a toner cloud. Detach toner from the cloud develops the latent image.

U.S. Pat. No. 4,984,019 discloses a developer unit having a donor roll with electrode wires disposed adjacent thereto in a development zone. A magnetic roll transports developer material to the donor roll. Toner particles are attracted from the magnetic roll to the donor roll. When the developer unit is inactivated, the electrode wires are vibrated to remove contaminants therefrom.

U.S. Pat. No. 5,422,709 teaches an apparatus in which a donor roll advances toner to an electrostatic latent image recorded on a photoconductive member. A plurality of electrode wires are positioned in the space between the donor roll and the photoconductive member. The electrode wires extend in a transverse direction relative to the longitudinal axis of the donor roll. The electrode wires are electrically biased to detach the toner from the donor roll so as to form a toner cloud in the space between the electrode wires and photoconductive members. Detached toner from the toner cloud develops the latent image. Electrode wires contact a portion of the surface of the donor roll. As the donor roll rotates, friction between the electrode wires and donor roll causes trapped debris to move away from the toner powder cloud region so as to minimize contamination produced streaks on the developed image.

A problem with developer systems using wires is that toner and/or toner constituents buildup on the wires over time and result in development defects. Wire contamination is a first class of defect in which toner and/or toner constituents buildup on the wire side that is in contact with the donor roll. Wire history is a second class of defect in which toner and/or toner constituents buildup on the wire side away from the donor roll. Wire history involves highly charged (though sometimes low charged) and generally small toner or other particles being attracted to the wire and sticking to the wire as a result of either adhesive or electrostatic attractive forces. The result is that contaminants build up on the electrodes, as a response to the image area coverage history, causing visible streaks on prints. Constant cleaning of the wires is required in order to alleviate the above-defects, which cleaning is time-consuming and inefficient in that it requires machine downtime.

Another problem is in machines which require large development zones that the width of the donor roll is such that a very large number of those wires are required to cover the whole printable area. The wrapping of this many wires poses very serious manufacturability challenges. In addition, the wires must all be supported at exactly the same tension which must be maintained. This poses both a design and manufacturability challenge, when either a single wire or a plurality of wires is used.

The present invention obviates the problems noted above by providing an apparatus for developing in a development zone a latent image recorded on a surface, including a housing defining a chamber storing at least a supply of toner therein; a donor member disposed of at least partially in the chamber of said housing and spaced from the surface, said donor member being adapted to rotate about a longitudinal axis to transport toner to the development zone in a region opposed from the surface; and a wire assembly module mounted the development zone and extending in a direction transverse to the longitudinal axis, said wire assembly module including a wire and a drive system for translating portions of the wire in the development zone, and power supply for electrically biasing said wire to detach toner from said donor member so as to form a toner powder cloud in the development zone with detached toner from the toner cloud developing the latent image.

BRIEF DESCRIPTION OF THE DRAWINGS

Other features of the present invention will become apparent as the following description proceeds and upon reference to the drawings, in which.

DETAILED DESCRIPTION

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
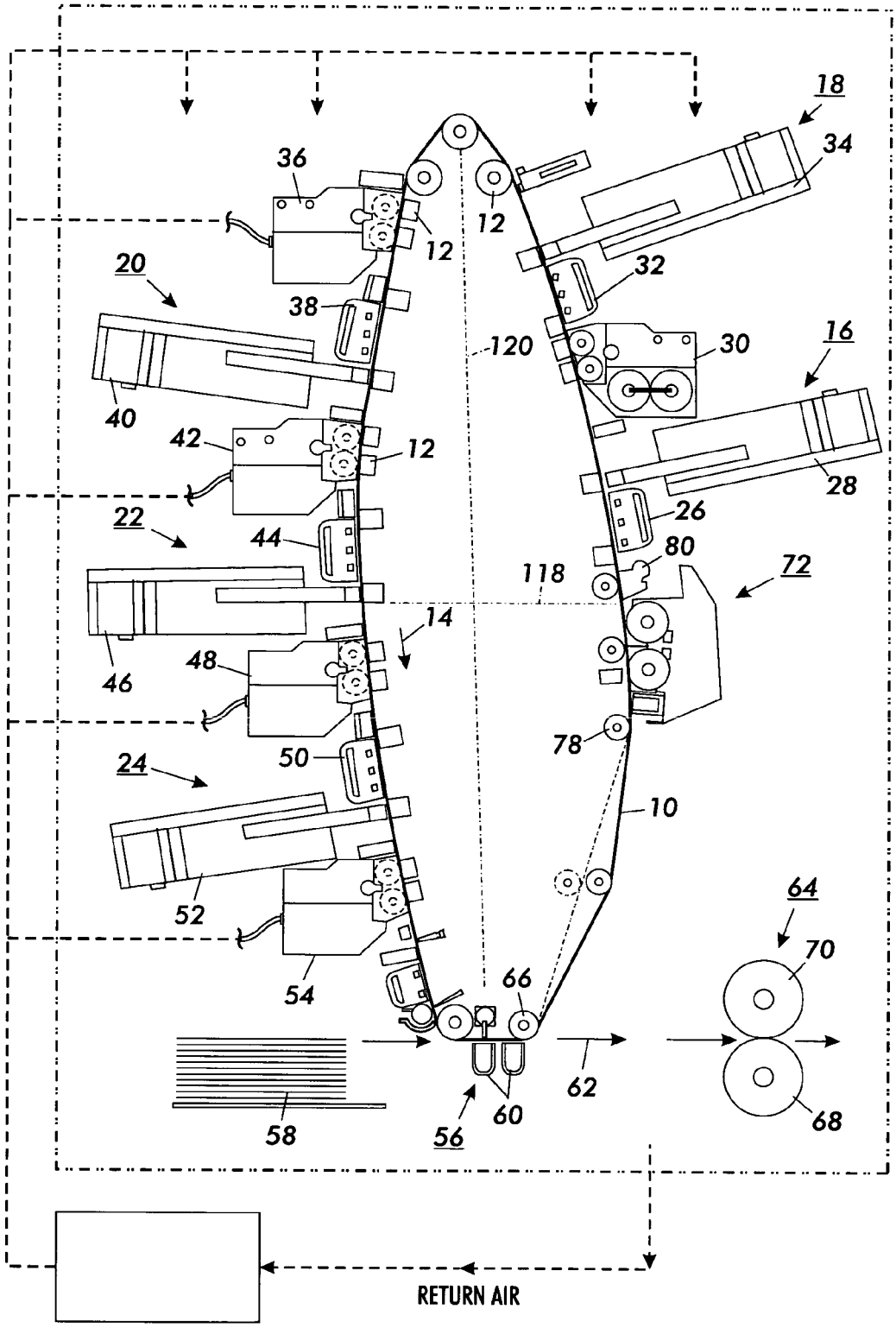
FIG. 1 is a schematic elevational view of an illustrative electrophotographic printing machine.

Referring now to the drawings, there is shown a single pass multi-color printing machine in FIG. 1. This printing machine employs the following components: a photoconductive belt 10, supported by a plurality of rollers or bars, 12. Photoconductive belt 10 is arranged in a vertical orientation. Photoconductive belt 10 advances in the direction of arrow 14 to move successive portions of the external surface of photoconductive belt 10 sequentially beneath the various processing stations disposed about the path of movement thereof. The photoconductive belt 10 has a major axis 120 and a minor axis 1 18. The major and minor axes 120, 118 are perpendicular to one another. Photoconductive belt 10 is elliptically shaped. The major axis 120 is substantially parallel to the gravitational vector and arranged in a substantially vertical orientation. The minor axis 118 is substantially perpendicular to the gravitational vector and arranged in a substantially horizontal direction. The printing machine architecture includes five image recording stations indicated generally by the reference numerals 16, 18, 20, 22, and 24, respectively. Initially, photoconductive belt 10 passes through image recording station 16. Image recording station 16 includes a charging device and an exposure device. The charging device includes a corona generator 26 that charges the exterior surface of photoconductive belt 10 to a relatively high, substantially uniform potential. After the exterior surface of photoconductive belt 10 is charged, the charged portion thereof advances to the exposure device. The exposure device includes a raster output scanner (ROS) 28, which illuminates the charged portion of the exterior surface of photoconductive belt 10 to record a first electrostatic latent image thereon. Alternatively, a light emitting diode (LED) may be used.

This first electrostatic latent image is developed by developer unit 30. Developer unit 30 deposits toner particles of a selected color on the first electrostatic latent image. After the highlight toner image has been developed on the exterior surface of photoconductive belt 10, photoconductive belt 10 continues to advance in the direction of arrow 14 to image recording station 18.

Image recording station 18 includes a recharging device and an exposure device. The charging device includes a corona generator 32 which recharges the exterior surface of photoconductive belt 10 to a relatively high, substantially uniform potential. The exposure device includes a ROS 34 which illuminates the charged portion of the exterior surface of photoconductive belt 10 selectively to record a second electrostatic latent image thereon. This second electrostatic latent image corresponds to the regions to be developed with magenta toner particles. This second electrostatic latent image is now advanced to the next successive developer unit 36.

Developer unit 36 deposits magenta toner particles on the electrostatic latent image. In this way, a magenta toner powder image is formed on the exterior surface of photoconductive belt 10. After the magenta toner powder image has been developed on the exterior surface of photoconductive belt 10, photoconductive belt 10 continues to advance in the direction of arrow 14 to image recording station 20.

Image recording station 20 includes a charging device and an exposure device. The charging device includes corona generator 38, which recharges the photoconductive surface to a relatively high, substantially uniform potential. The exposure device includes ROS 40 which illuminates the charged portion of the exterior surface of photoconductive belt 10 to selectively dissipate the charge thereon to record a third electrostatic latent image corresponding to the regions to be developed with yellow toner particles. This third electrostatic latent image is now advanced to the next successive developer unit 42.

Developer unit 42 deposits yellow toner particles on the exterior surface of photoconductive belt 10 to form a yellow toner powder image thereon. After the third electrostatic latent image has been developed with yellow toner, photoconductive belt 10 advances in the direction of arrow 14 to the next image recording station 22.

Image recording station 22 includes a charging device and an exposure device. The charging device includes a corona generator 44, which charges the exterior surface of photoconductive belt 10 to a relatively high, substantially uniform potential. The exposure device includes ROS 46, which illuminates the charged portion of the exterior surface of photoconductive belt 10 to selectively dissipate the charge on the exterior surface of photoconductive belt 10 to record a fourth electrostatic latent image for development with cyan toner particles. After the fourth electrostatic latent image is recorded on the exterior surface of photoconductive belt 10, photoconductive belt 10 advances this electrostatic latent image to the cyan developer unit 48.

Developer unit 48 deposits cyan toner particles on the fourth electrostatic latent image. These toner particles may be partially in superimposed registration with the previously formed yellow powder image. After the cyan toner powder image is formed on the exterior surface of photoconductive belt 10, photoconductive belt 10 advances to the next image recording station 24.

Image recording station 24 includes a charging device and an exposure device. The charging device includes corona generator 50 which charges the exterior surface of photoconductive belt 10 to a relatively high, substantially uniform potential. The exposure device includes ROS 52, which illuminates the charged portion of the exterior surface of photoconductive belt 10 to selectively discharge those portions of the charged exterior surface of photoconductive belt 10 which are to be developed with black toner particles. The fifth electrostatic latent image, to be developed with black toner particles, is advanced to black developer unit 54.

At black developer unit 54, black toner particles are deposited on the exterior surface of photoconductive belt 10. These black toner particles form a black toner powder image which may be partially or totally in superimposed registration with the previously formed highlight color, yellow, magenta, and cyan toner powder images. In this way, a multi-color toner powder image is formed on the exterior surface of photoconductive belt 10. Thereafter, photoconductive belt 10 advances the multi-color toner powder image to a transfer station, indicated generally by the reference numeral 56.

All xerographic subsystems are environmentally maintained inside the xero cavity. Air from and to the xero cavity is conditioned/filtered to predefined set points by using a special design environmental unit.

At transfer station 56, a receiving medium, i.e., paper, is advanced from stack 58 by sheet feeders and guided to transfer station 56. At transfer station 56, a corona generating device 60 sprays ions onto the backside of the paper. This attracts the developed multi-color toner image from the exterior surface of photoconductive belt 10 to the sheet of paper. Stripping assist roller 66 contacts the interior surface of photoconductive belt 10 and provides a sufficiently sharp bend thereat so that the beam strength of the advancing paper is stripped from photoconductive belt 10. A vacuum transport moves the sheet of paper in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets which may be bound to one another. These sets are then advanced to a catch tray for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Invariably, after the multi-color toner powder image has been transferred to the sheet of paper, residual toner particles remain adhering to the exterior surface of photoconductive belt 10. The photoconductive belt 10 moves over isolation roller 78 which isolates the cleaning operation at cleaning station 72. At cleaning station 72, the residual toner particles are removed from photoconductive belt 10. Photoconductive belt 10 then moves under spots blade 80 to also remove toner particles therefrom.

Environmental conditioning unit maintains the printing machine components enclosed in enclosure at a predefined temperature and humidity. The Environmental Unit (EU) is an air conditioning unit with dual air flow discharge to provide cooling, heating and dehumidification to the xerographic enclosure/developer housings of the print engine. The EU provides the Print Engine precise control of temperature and humidity to assure stability of the PE advanced technologies so as to produce a new industry benchmark in image quality and productivity.

Figure 2:
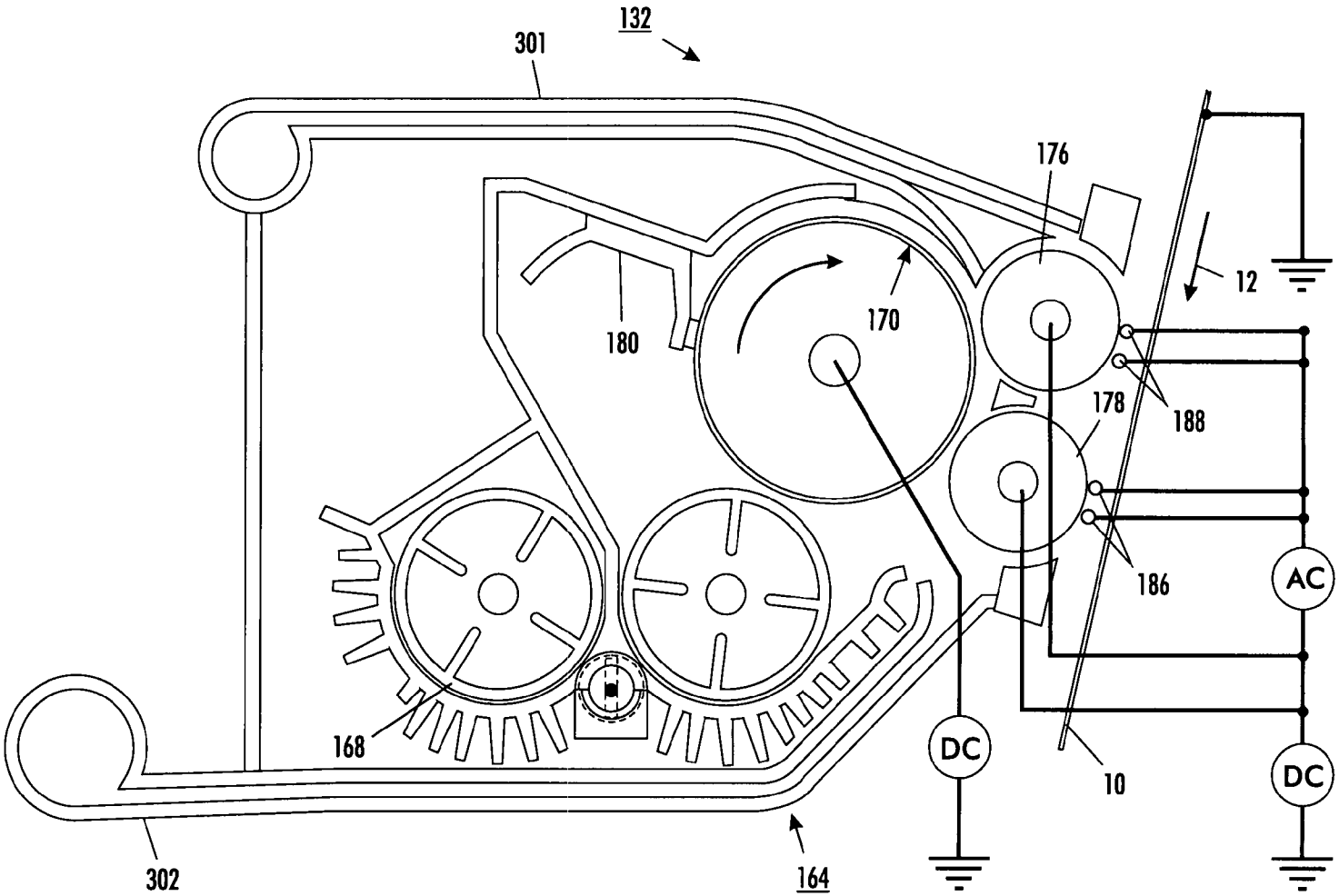
FIG. 2 is a schematic elevational view showing the development apparatus used in the FIG. 1 printing machine.

Referring now to FIG. 2, there is shown the details of a development apparatus 132. The apparatus comprises a reservoir or developing housing 164 containing developer material. The developer material is of the two component type, that is it comprises carrier granules and toner particles. The reservoir 164 includes augers 168, which are rotatably-mounted in the reservoir chamber. The augers 168 serve to transport and to agitate the developer material within the reservoir 164 and encourage the toner particles to adhere triboelectrically to the carrier granules. A magnetic brush roll 170 transports developer material from the reservoir 164 to loading nips of donor rolls 176, 178. Magnetic brush rolls are well known, so the construction of magnetic brush roll 170 need not be described in great detail. Briefly the magnetic brush roll 170 comprises a rotatable tubular housing within which is located a stationary magnetic cylinder having a plurality of magnetic poles impressed around its surface. The carrier granules of the developer material are permeable, as the tubular housing of the magnetic brush roll 170 rotates, the granules (with toner particles adhering triboelectrically thereto) are attracted to the magnetic brush roll 170 and are conveyed to the donor roll loading nips. A trim bar 180 removes excess developer material from the magnetic brush roll 170 and ensures an even depth of coverage with developer material before arrival at the loading nip of donor roll 176. At each of the donor roll loading nips, toner particles are transferred from the magnetic brush roll 170 to the respective donor rolls 176, 178.

Donor rolls 176, 178 transport the toner to a respective development zone through which the photoconductive belt 10 passes. Transfer of toner from the magnetic brush roll 170 to the donor rolls 176, 178 can be encouraged by, for example, the application of a suitable D.C. electrical bias to the magnetic brush roll 170 and/or donor rolls 176, 178. The D.C. bias (for example, approximately 100 v applied to the magnetic brush roll 170) establishes an electrostatic field between the magnetic brush roll 170 and donor rolls 176, 178, which causes toner particles to be attracted to the donor rolls 176, 178 from the carrier granules on the magnetic brush roll 170.

The carrier granules and any toner particles that remain on the magnetic brush roll 170 are returned to the reservoir 164 as the magnetic brush roll 170 continues to rotate. The relative amounts of toner transferred from the magnetic brush roll 170 to the donor rolls 176, 178 can be adjusted, for example by: applying different bias voltages to the donor rolls 176, 178; adjusting the magnetic brush roll to donor roll spacing; adjusting the strength and shape of the magnetic field at the loading nips and/or adjusting the speeds of the donor rolls 176, 178.

At each of the development zones, toner is transferred from the respective donor rolls 176, 178 to the latent image on the photoconductive belt 10 to form a toner powder image on the latter. In FIG. 2, each of the development zones is shown as having the form i.e. electrode wires 186, 188 are disposed in the space between each donor rolls 176, 178 and photoconductive belt 10. FIG. 2 shows, for each donor rolls 176, 178 a respective pair of electrode wires 186, 188 extending in a direction substantially parallel to the longitudinal axis of the donor rolls 176, 178. The electrode wires 186, 188 are made from thin (i.e. 50 to 100 mu. diameter) tungsten wires which are closely spaced from the respective donor rolls 176, 178. The distance between each pair of electrode wires 186, 188 and the respective donor rolls 176, 178 is within the range from about 10 .mu. to about 40 mu. (typically approximately 25 mu.) or the thickness of the toner layer on the donor rolls 176, 178. The electrode wires 186, 188 are self-spaced from the donor rolls 176, 178 by the thickness of the toner on the donor rolls 176, 178. To this end the extremities of the electrode wires 186, 188 are supported by wire module of the present invention. The electrode wires 186, 188 extremities are supported by wire module so that they are slightly below a tangent to the surface, including the toner layer, of the donor rolls 176, 178. An alternating electrical bias is applied to the electrode wires 186, 188 by an AC voltage source.

The applied AC establishes an alternating electrostatic field between each pair of electrode wires 186, 188 and the respective donor rolls 176, 178, which is effective in detaching toner from the surface of the donor rolls 176, 178 and forming a toner cloud about the electrode wires 186, 188, the height of the cloud being such as not to be substantially in contact with the photoconductive belt 10. The magnitude of the AC voltage is relatively low, for example in the order of 200 to 500 volts peak a frequency ranging from about 3 kHz to about 10 kHz. A DC bias supply (not shown) applied to donor rolls 176, 178 establishes electrostatic fields between the photoconductive belt 10 and donor rolls 176, 178 for attracting the detached toner particles from the clouds surrounding the electrode wires 186, 188 to the latent image recorded on the photoconductive surface of the photoconductive belt 10. At a spacing ranging from about 10 mu. to about 40 mu. between the electrode wires 186, 188 and donor rolls 176, 178, an applied voltage of 200 to 500 volts produces a relatively large electrostatic field without risk of air breakdown.

After development, toner may be stripped from the donor rolls 176, 178 by respective cleaning blades (not shown) so that magnetic brush roll 170 meters fresh toner to clean donor rolls 176, 178. As successive electrostatic latent images are developed, the toner particles within the developer material are depleted. A toner dispenser (not shown) stores a supply of toner particles. The toner dispenser is in communication with reservoir 164 and, as the concentration of toner particles in the developer material is decreased, fresh toner particles are furnished to the developer material in the reservoir 164. The augers 168 in the reservoir chamber mix the fresh toner particles with the remaining developer material so that the resultant developer material therein is substantially uniform with the concentration of toner particles being optimized. In this way, a substantially constant amount of toner particles is in the reservoir 164 with the toner particles having a constant charge.

In the arrangement shown in FIG. 2, the donor rolls 176, 178 and the magnetic brush roll 170 can be rotated either "with" or "against" the direction of motion of the photoconductive belt 10. The developer housing employs a system to control toner emission which is composed of twe manifolds 301 and 302. The location of the two manifolds are placed above and below the upper and lower donor rolls respectively. The manifolds are mounted in a position to improve emissions control as well as reductions in the flow needed to accomplish the task.

It is believed that the foregoing description is sufficient for purposes of the present application to illustrate the general operation of an electrophotographic printing machine incorporating the developer unit of the present invention therein.

Figure 3:
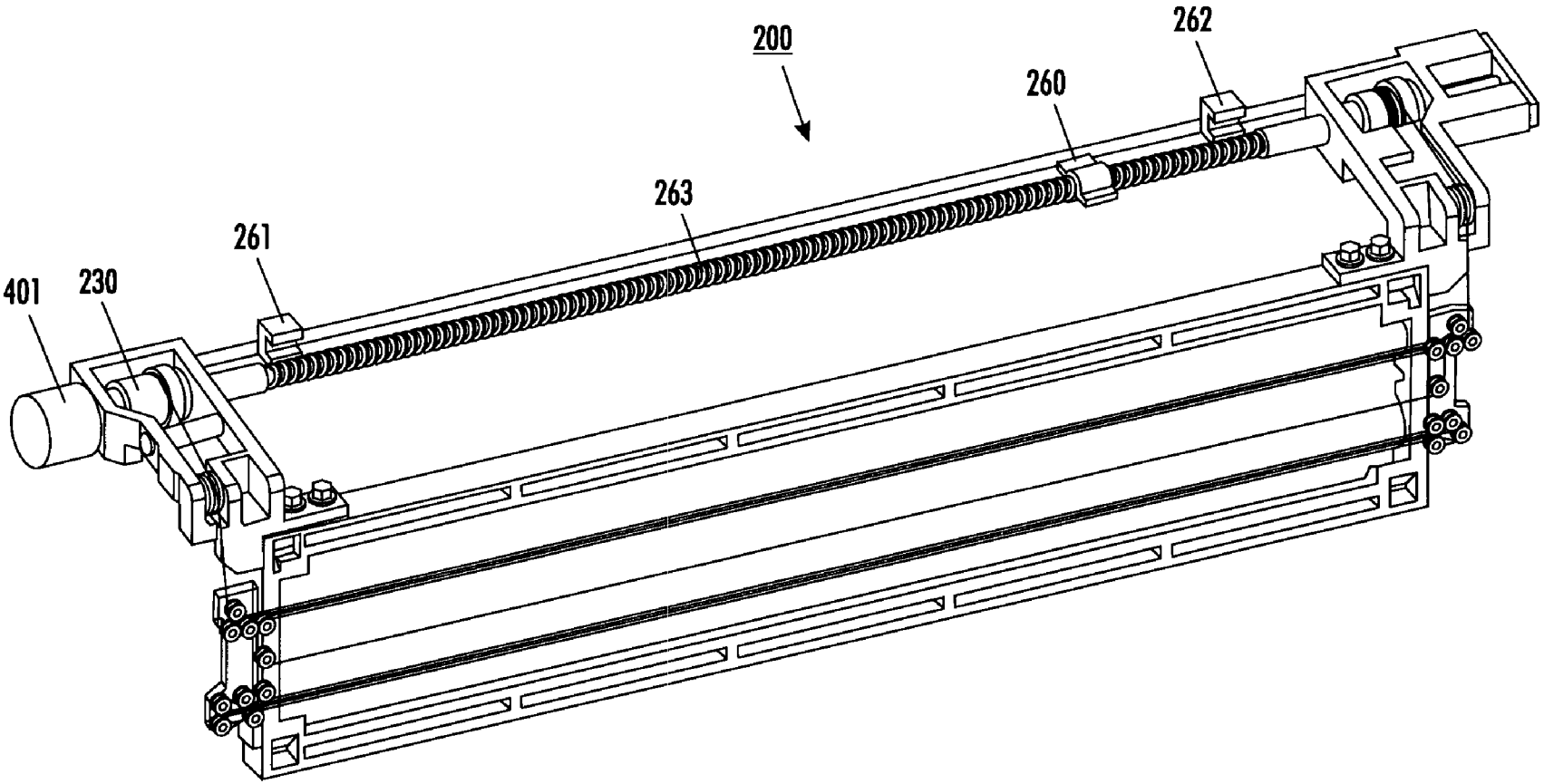
FIGS. 3–5 are views showing the wire module assembly, the electrode wire with the wire stringing method, drive motor, and framework that holds it all together.
Figure 4:
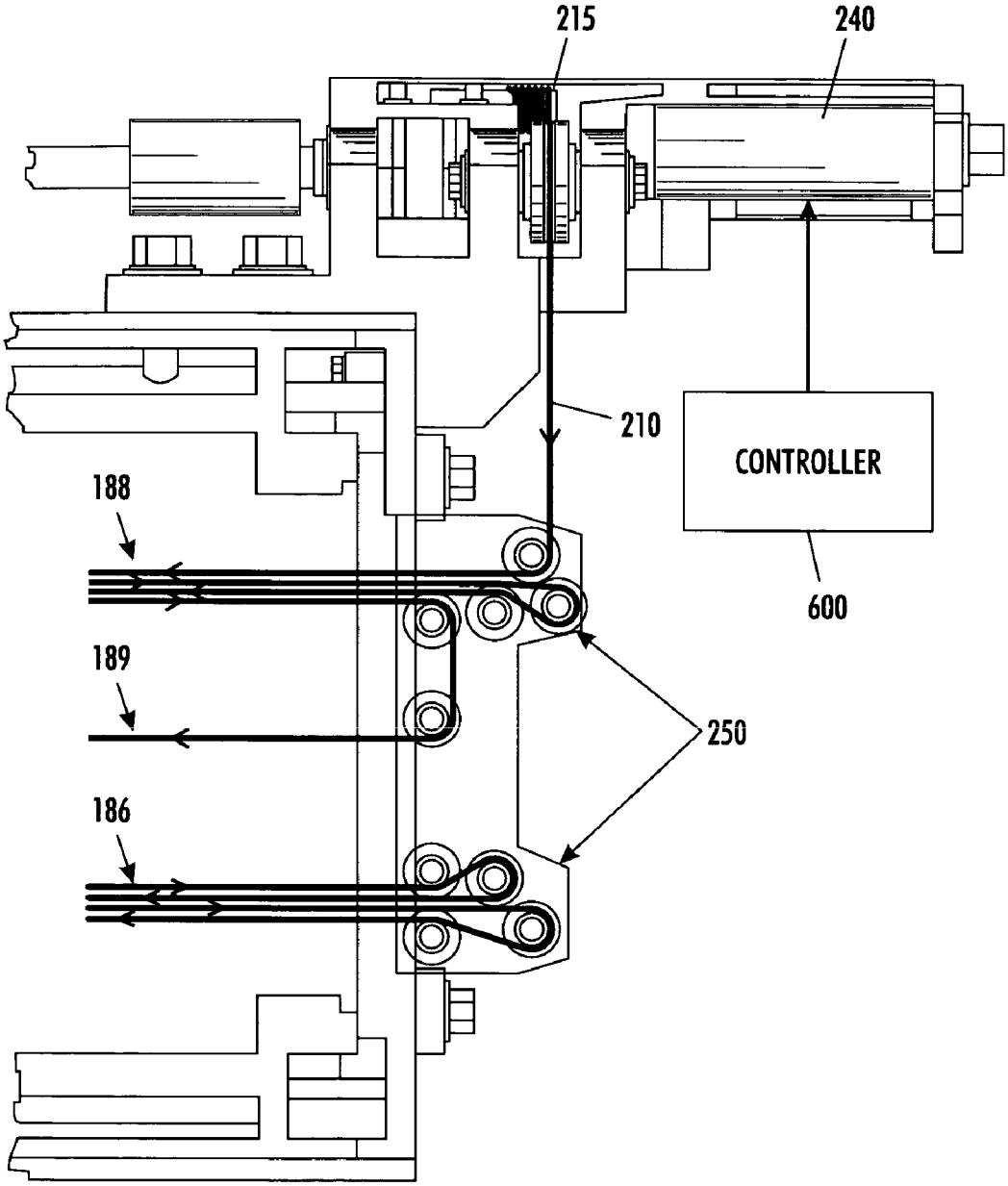
Figure 5:
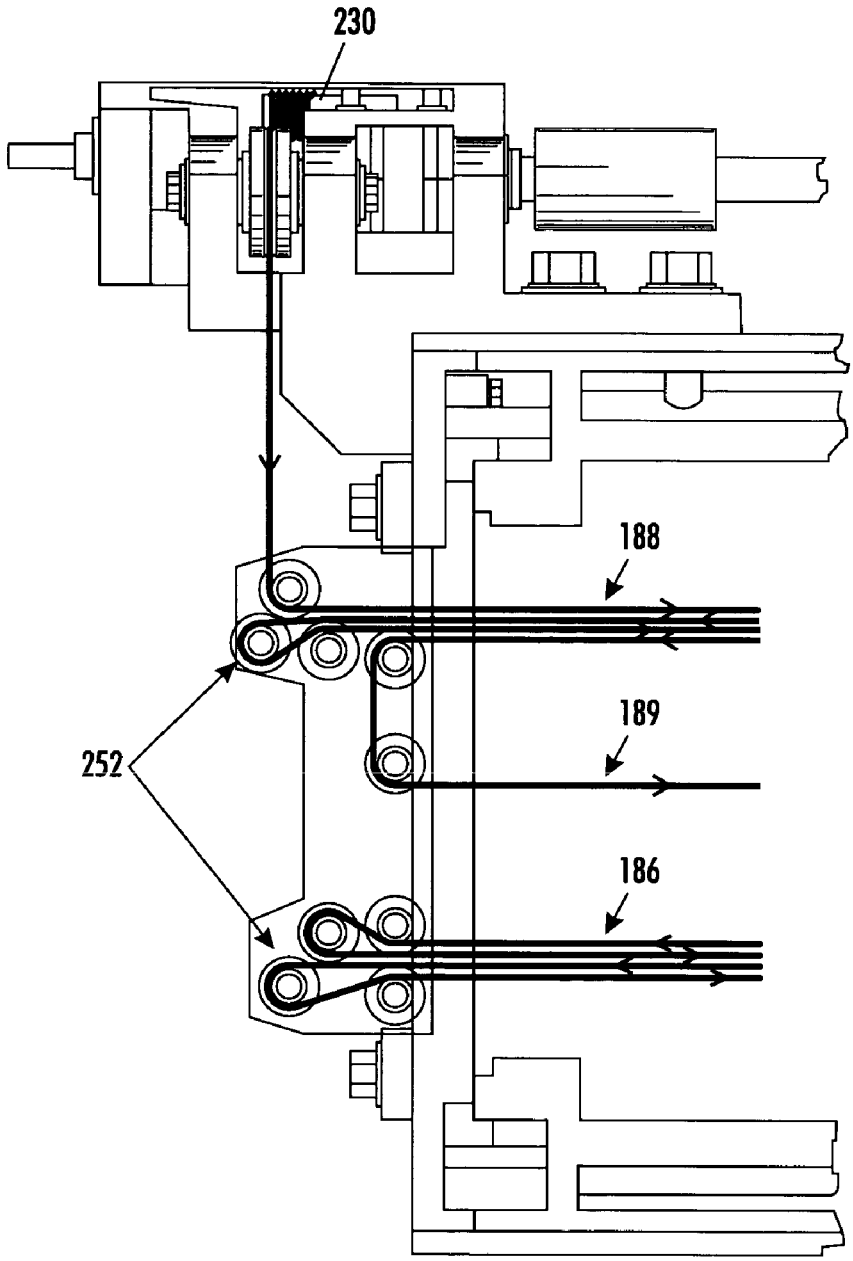

Now focusing on FIGS. 3 and 4, an embodiment of a wire module assembly 200. Wire 210 is wound onto supply spool 215 and wire is threaded within wire module assembly 200 so that it presents wire strands sets 188 and 186 along the length of each donor roll 176 and 178. Wire 210 terminates on a take-up spool 230. Applicants have found that space was more efficiently utilized if take-up spool 230 is placed at the opposite end of the donor roll from supply spool 215. This method of stringing wire produced a 9th wire strand 189 that runs parallel to the donor roll axis yet far enough away from the donor roll as not to be involved in the activity of development. A drive system 240 is connected to the spools 215 and 230 so when drive system rotates it drives both spools together. The wire drive s stem includes a controller 600 for sendin a control signal to The drive system to translate portions of the wire from the supply spool or take-up spool when desired. The controller may send the control signal to the drive system to translate the wire in response to an image fault signal.

The spacing of the wire strands to each other positioned between the donor roll and the photoreceptor belt is a critical parameter. This spacing is set by the position of the pulleys assemblies 250 and 252 that are at the end of the donor rolls.

In operation, as the motor drive system drives spools rotate and the wire moves from the supply spool) to the take-up spool. As the wire moves between the spools it moves along the axis of each donor roll due to the stringing method. The direction of movement is parallel to the axis of the donor rolls. Further, as the wire moves it also rotates about the wire axis as due the wounding of the wire on the spools. Applicants have found that the toner and/or additives often contaminate the wire during machine operation. This contamination occurs in areas of non-image. When a different image is printed there is a potential for an image defect known as "wire history" to appear. This defect is undesirable. When the wire moves parallel to the axis of the donor rolls during printing the image defect is blurred. Through this blurring the image defect is not as noticeable and therefore is acceptable to the customer. Moving a wire, or wires, is a unique way to solve this image defect. Further, applicants have found that cleaning the wire also occurs by the relative motion to the donor roll.

A wire sensing includes a lead screw 263, flag 260 and switches 261 and 262.

When the motor turns it also turns the lead screw 263. Mounted on the lead screw is a flag. The lead screw has a male thread on the outside diameter and the flag has a female thread in the bore. The flag is designed and mounted such that it will not rotate with the lead screw. As the lead screw rotates the flag moves axially along the lead screw. There are two switches mounted to the developer, one on the outboard (OB) end and one on the inboard (IB) end. These switches and the flag are positioned such that when most of the wire that was on the supply spool moves to the take-up spool or visa versa the flag actuates a switch and the motor drive system reverses. This reversal is timed so that there is always wire on both spools. This reversal was a strategy chosen to use the same wire over and over as a means to maximize the time between wire module replacements.

This wire module assembly is purchased from a supplier with the wire tensioned. In this design there is no tension adjustment after it is initially set. The Wire tension set point ie. 565±25 Hz. The tension procedure is: mount the wire module assembly to the wire tensioning fixture; attach a brake 401 to the OB end of the take-up spool shaft and set brake to yield a wire tension of 565±25 Hz; load approximately 4,200 mm of wire onto the take-up spool; string the wire through the wire module and terminate the end of the wire on the supply spool; detach the GB coupling from the take-up spool; turn on the motor so that the wire will wind up on the supply spool. With the take-up spool attached to the brake and not attached to the motor the wire will become tensioned; attach the GB coupling to the take-up spool; the wire is now tensioned; detach the brake from the GB end of the take-up spool shaft.

It is, therefore, apparent that there has been provided in accordance with the present invention a development system that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An apparatus for developing in a development zone a latent image recorded on a surface, including:

a housing defining a chamber storing at least a supply of toner therein;

a donor member disposed of at least partially in the chamber of said housing and spaced from the surface, said donor member being adapted to rotate about a longitudinal axis to transport toner to the development zone in a region opposed from the surface; and a wire assembly module mounted the development zone and extending in a direction transverse to the longitudinal axis, said wire assembly module including a wire and a drive system for translating portions of the wire in the development zone, and means for electrically biasing said wire to detach toner from said donor member so as to form a toner powder cloud in the development zone with detached toner from the toner cloud developing the latent image, said wire assembly module further includes a stringing system for arranging said wire into plurality of elongated wires with adjacent wires being spaced from and substantially parallel to one another and wherein said plurality of wires contact said donor member.

2. An apparatus according to claim 1, wherein said drive system includes means for supporting said plurality of wires at a preselected tension.

3. An apparatus according to claim 2, wherein said wire drive system includes a supply spool for holding unused portions of said wire and a take-up spool for holding used portion of said wire.

4. An apparatus according to claim 1 wherein said wire drive system includes a controller for sending a control signal to said drive system to translate portions of said wire from a supply spool or a take-up spool when desired.

5. An apparatus according to claim 4, wherein said controller sends said control signal to said drive system to translate said wire in response to an image fault signal.

6. An apparatus according to claim 4, wherein said controller includes a sensor for detecting amount of wire acquired in either said supply spool or said take-up spool.

7. An apparatus according to claim 1, wherein said wire rotates about its axis as the wire translate across the donor member.

8. An apparatus for developing in a development zone a latent image recorded on a surface, including:

a housing defining a chamber storing at least a supply of toner therein;

a donor member disposed of at least partially in the chamber of said housing and spaced from the surface, said donor member being adapted to rotate about a longitudinal axis to transport toner to the development zone in a region opposed from the surface; and a wire assembly module mounted the development zone and extending in a direction transverse to the longitudinal axis, said wire assembly module including a wire and a drive system for translating portions of the wire in the development zone, and means for electrically biasing said wire to detach toner from said donor member so as to form a toner powder cloud in the development zone with detached toner from the toner cloud developing the latent image, said wire assembly module further includes a stringing system for arranging said wire into plurality of elongated wires with adjacent wires and wherein adjacent wires are translated in opposite direction from each other.

9. An electrophotographic printing machine for developing in a development zone a latent image recorded on an imageable surface, including: a housing defining a chamber storing at least a supply of toner therein;

a donor member disposed of at least partially in the chamber of said housing and spaced from the surface, said donor member being adapted to rotate about a longitudinal axis to transport toner to the development zone in a region opposed from the surface; and a wire assembly module mounted the development zone and extending in a direction transverse to the longitudinal axis, said wire assembly module including a wire and a wire drive system for translating portions of the wire in the development zone, and means for electrically biasing said wire to detach toner from said donor member so as to form a toner powder cloud in the development zone with detached toner from the toner cloud developing the latent image, a stringing system for arranging said wire into plurality of elongated wires with adjacent wires being spaced from and substantially parallel to one another and wherein said plurality of wires contact said donor member.

10. An apparatus according to claim 9, wherein said drive system includes means for supporting said plurality of wires at a preselected tension.

11. An apparatus according to claim 10, wherein said wire drive system includes a supply spool for holding unused portions of said wire and a take-up spool for holding used portion of said wire.

12. An apparatus according to claim 10, wherein said wire drive system includes a controller for sending a control signal to said drive system to translate portions of said wire from a supply spool or a take-up spool when desired.

13. An apparatus according to claim 12, wherein said controller sends said control signal to said drive system to translate said wire in response to an image fault signal.

14. An apparatus according to claim 12, wherein said controller includes a sensor for detecting amount of wire acquired in either said supply spool or said take-up spool.

15. An apparatus according to claim 9, wherein said wire rotates about its axis as the wire translate across the donor member.

16. An electrophotographic printing machine for developing in a development zone a latent image recorded on an imageable surface, including: a housing defining a chamber storing at least a supply of toner therein;

a donor member disposed of at least partially in the chamber of said housing and spaced from the surface, said donor member being adapted to rotate about a longitudinal axis to transport toner to the development zone in a region opposed from the surface; and a wire assembly module mounted the development zone and extending in a direction transverse to the longitudinal axis, said wire assembly module including a wire and a wire drive system for translating portions of the wire in the development zone, and means for electrically biasing said wire to detach toner from said donor member so as to form a toner powder cloud in the development zone with detached toner from the toner cloud developing the latent image, a stringing system for arranging said wire into plurality of elongated wires with adjacent wires and wherein adjacent wires are translated in opposite direction from each other.

* * * * *